US006240759B1

(12) United States Patent
Blaimschein

(10) Patent No.: US 6,240,759 B1
(45) Date of Patent: Jun. 5, 2001

(54) FORGING MACHINE

(75) Inventor: Gottfried Blaimschein, Steyr (AT)

(73) Assignee: GFM Beteiligungs- und Management GmbH & Co. KG, Steyr (AT)

( * ) Notice: Subject to any disclaimer, the term of this patent is extended or adjusted under 35 U.S.C. 154(b) by 0 days.

(21) Appl. No.: 09/456,005

(22) Filed: Dec. 7, 1999

(30) Foreign Application Priority Data

Dec. 7, 1998 (AT) ..... 2051/98

(51) Int. Cl.[7] ..... B21J 7/16
(52) U.S. Cl. ..... 72/76; 72/452.6
(58) Field of Search ..... 72/76, 402, 403, 72/452.6

(56) References Cited

U.S. PATENT DOCUMENTS 5,315,926 * 5/1994 Kanamaru et al. ..... 72/452.6

* cited by examiner

*Primary Examiner*—Lowell A. Larson
(74) *Attorney, Agent, or Firm*—Collard & Roe, P.C.

(57) ABSTRACT

A forging machine (1) comprises at least two forging punches (3) acting against each other and longitudinally guided in a forging box (1), which forging punches each have separate mechanical lifting drives and preferably vertical position adjusting means. To achieve a rugged lifting drive with high machine rigidities and a simplified construction, the lifting drives are comprised of a wobble plate drive (5) including a wobble plate (6) rotatably and drivably, but immovably mounted in the forging box (1) about a wobble axis (T) offset in parallel to the respective forging punch axis (S), and a pressure plate (9) associated to the wobble plate (6) and supported in the manner of a ball-and-socket joint on the end face of the associated forging punch (3) facing the wobble plate, where preferably the forging punches (3) can be pressurized via pressure springs (11) in the sense of a frictional connectoin of wobble plates (6) and pressure plates (9).

7 Claims, 3 Drawing Sheets

FORGING MACHINE

1. FIELD OF THE INVENTION

This invention relates to a forging machine comprising at least two forging punches acting against each other and longitudinally guided in a forging box, which each have separate mechanical lifting drives and preferably vertical position adjusting means.

2. DESCRIPTION OF THE PRIOR ART

In known forging machines, eccentric drives are mostly used as mechanical lifting drives, where the rotary movement of the eccentrics is converted into lifting movements of the forging punches due to a cooperation of sliding blocks rotatably mounted on the eccentrics and connecting rod heads of the forging punches accommodating the sliding blocks. The forging forces which occur during forging therefore apply a bending load onto the eccentric shafts via the forging punches, so that these eccenctric shafts must be dimensioned and supported accordingly, which involves an increased constructional effort. To adjust the vertical position of the forging punches, there must also be provided special adjustment housings for mounting the eccentric shafts, whereby the machine frame is weakened in its rigidity because of the required bearing lugs, and due to the displacement of the center of the eccentric shafts during the adjustment a suitable eccentric shaft drive compensating this offset is required. When the forging punches are composed of two parts screw-connected with each other for adjusting the vertical position, of which screw-connected parts the one is non-rotatably guided with respect to the forging box and the other is rotatably guided, and the rotatable part communicates with a rotary drive, so that because of the mutual screw connection of the parts a rotation of the rotatable part effects a change in length of the forging punch and thus an adjustment of the vertical position, the impairment of the load-bearing capacity of the punches must be taken into account in addition to the lifting movement of the punches, which requires a relative axial movability of the rotating part with respect to the rotary drive and likewise leads to a more complex construction.

SUMMARY OF THE INVENTION

It is therefore the object underlying the invention to create a forging machine as described above, which is characterized by its novel drive concept and the related high rigidity and simplified construction.

This object is solved by the invention in that the lifting drives are comprised of a wobble-plate drive including a wobble plate rotatably and drivably, but immovably mounted in the forging box about a wobble axis offset in parallel with respect to the respective forging punch axis and a pressure plate associated to the wobble plate and supported in the manner of a ball-and-socket joint on the end face of the associated forging punch facing the wobble plate, where preferably the forging punches can be pressurized via pressure springs in the sense of a frictional connection of wobble plates and pressure plates. By rotating the wobble plate, which is eccentric with respect to the forging punch axis, a lifting movement with a frequency corresponding to the rotational speed of the wobble plate is forced onto the forging punch in dependence on the inclination of the wobble plate and the eccentricity, which lifting movement serves the forming of the workpiece. The occurring forging forces are substantially directly transferred from the forging punch via the pressure plate to the wobble plate, which leads to pure pressure loads and involves an increased machine rigidity with simplified supporting conditions. There is a frictional cooperation between wobble plates and pressure plates, which is ensured by appropriate loads of the forging punches. There are expediently used pressure springs, for instance hydraulic cylinders connected to an accumulator, which urge the pressure plates and wobble plates against each other and prevent the same from being lifted off each other.

In accordance with a particularly advantageous aspect of the invention, a shaft stub of the wobble plate is rotatably, but axially immovably seated in a bearing sleeve axially movably supported in the machine box, so that a change in the vertical position is effected by a longitudinal adjustment of the bearing sleeve independent of the actual lifting movement of the forging punches, as by means of the change in the axial position of the wobble plates there are also adjusted the axial positions of the pressure plates and thus of the forging punches. The bearing sleeve in addition provides for a stable support of the drum plate, where here as well bending loads are largely avoided.

The bearing sleeve as such might axially adjustably be inserted in the machine box in any suitable way, where a screw drive is, however, particularly suited for longitudinal adjustment, and the external thread of the bearing sleeve engages in an adjusting nut rotatably, but axially immovably supported in the forging box, to which adjusting nut a rotary drive is associated. Rotating the adjusting nut effects a corresponding change in the axial position of the bearing sleeve due to its screw connection with the bearing sleeve, where the parts of the screw drive can take high loads and transfer the same to the forging box.

When the rotary drives each include a drive gear, which drive gears cooperate with a central wheel mounted at the forging box so as to be rotated about the axis of movement, a common adjustment of the vertical position of all forging punches can be achieved without major difficulties.

The wobble plate can be driven in various ways, and the wobble plate can for instance be driven via a toothed-belt drive and together with a peripheral gear rim forms the one crown gear thereof, which wobble plate drive can be accommodated in the forging box in a space-saving way and provides for the simple use of corresponding transmission ratios to achieve the desired rotational speed of the wobble plate.

To provide a common drive for all wobble plate drives, the wobble plates of all wobble plate drives can be driven via a common bevel gear transmission comprising a large bevel gear mounted on the forging box so as to be rotated and driven about the axis of movement and small bevel gears associated to the wobble plates, which leads to synchronous hammering movements in an economic way. The wobble plate drive as lifting drive is suited not only for forging machines with stationary forging box, but also for forging machines used as swaging machines, in which case the forging box is mounted in a machine frame so as to be rotated and driven about the axis of movement. Since the lifting drives and the vertical position adjusting means are disposed and supported at the forging box, their mode of function is not changed by the rotary support of the forging box, and the common adjustment of the vertical position and/or the common wobble plate drive are also maintained when the respective drive gears are part of planetary gear systems.

BRIEF DESCRIPTION OF THE DRAWING

In the drawing, the subject-matter of the invention is illustrated purely schematically, wherein.

DESCRIPTION OF THE PREFERRED EMBODIMENT

Figure 1:
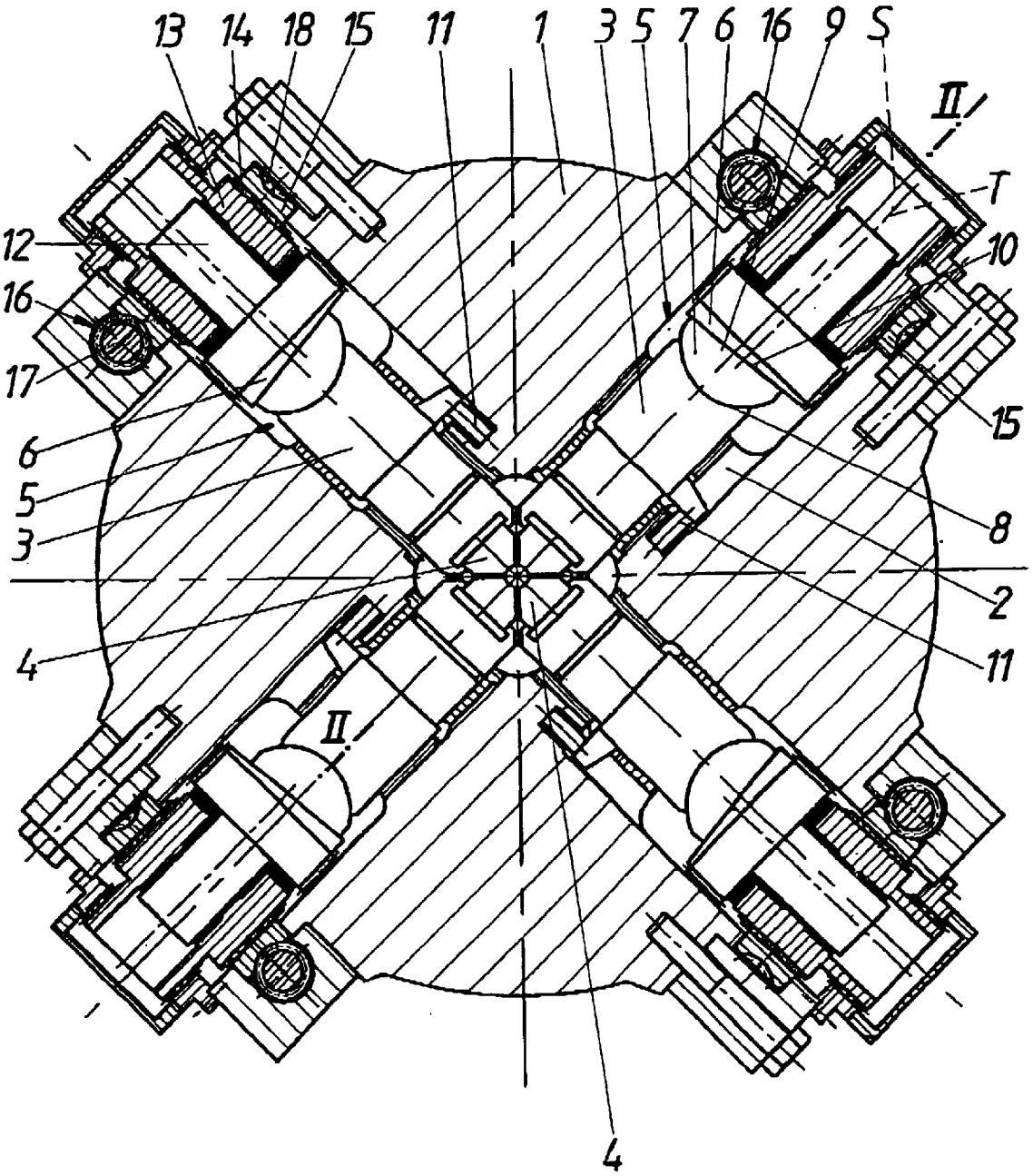
FIGS. 1 and 2 show an inventive forging machine in a cross-section along line I—I of FIG. 2 and in an axial section along line II—II of FIG. 1 on a larger scale.
Figure 2:
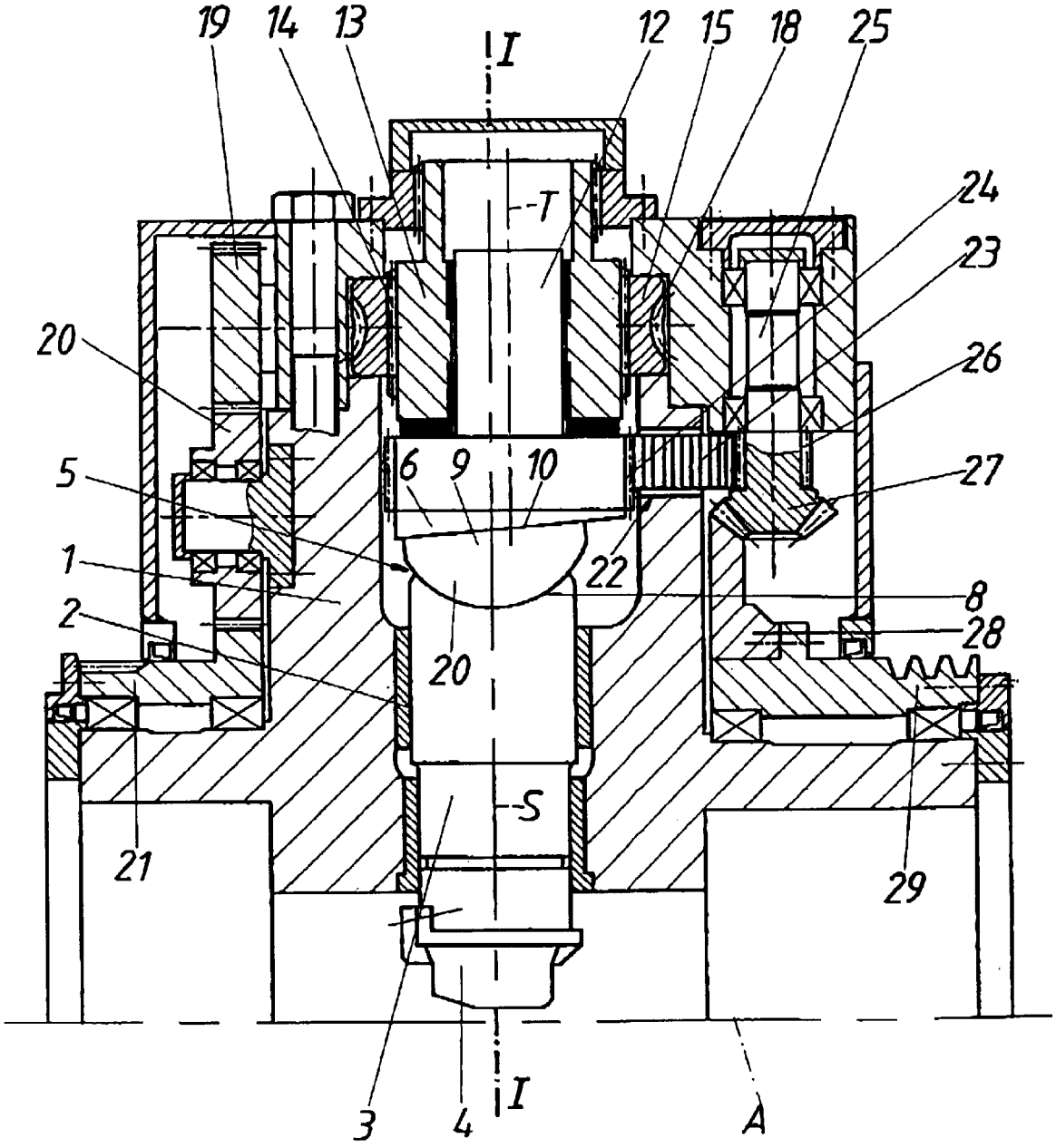

In a forging box 1, forging punches 3 acting against each other are longitudinally guided in radial recesses 2, which at their radially inner ends accommodate forging tools 4. As lifting drive for the forging punches 3 wobble plate drives 5 are provided, which are each comprised of a wobble plate 6 mounted in the forging box 3 so as to be rotated and driven about a wobble axis T offset in parallel to the respective forging punch axis S and a pressure plate 9 associated to the wobble plate 6 and supported in the manner of a ball-and-socket joint on the end face of the associated forging punch 3 facing the wobble plate via a spherical bearing body 7 and a spherical bearing shell 8. Wobble plate 6 and pressure plate 9 are frictionally connected with each other by their slide faces 10 resting against each other, where the forging punches 3 can be pressurized radially outwardly via pressure springs 11 supported in the machine box 1, thereby urging pressure plates 9 and wobble plates 6 against each other. With a shaft stub 12, the wobble plates 6 are rotatably, but axially immovably seated in a bearing sleeve 13 supported in the machine box I so as to be axially adjustable, where an external thread 14 of said bearing sleeve in turn engages in an adjusting nut 15 which is rotatably, but axially immovably supported in the forging box 1, where the adjusting nut 15 can be rotated via a rotary drive 16, which is comprised of a worm 17 and a worm gear rim 18 formed by the adjusting nut 15 on the outer periphery. The worm 17 is connected with a drive gear 19, which drive gears 19 are meshing via intermediate wheels with a central wheel 21 mounted at the forging box 1 so as to be rotated and driven about the forging axis A. Therefore, when the central wheel 21 is driven, a rotary adjustment of the adjusting nut 13 and thus a change in the axial position of the bearing sleeve 13 is effected via the rotary drive 16, whereby the wobble plate 6 is adjusted axially, and the vertical position of the forging punches 3 is also changed necessarily.

For driving the wobble plate 6 a toothed-belt drive 22 is used, whose rotating toothed belt 23 connects a peripheral gear rim 24 of the wobble plate 6 as crown gear with a crown gear 26 seated on a parallel bevel gear shaft 25. On the bevel gear shaft 25 a small bevel gear 27 is seated, which is meshing with a large bevel gear 28 mounted on the forging box 1 so as to be rotated and driven coaxial to the forging axis A. Driving this large bevel gear 28, for instance via a pulley 29, therefore leads to driving the toothed-belt drive 22 and thus to the rotation of the wobble plate and the lifting movement of the forging punches 3.

Figure 3:
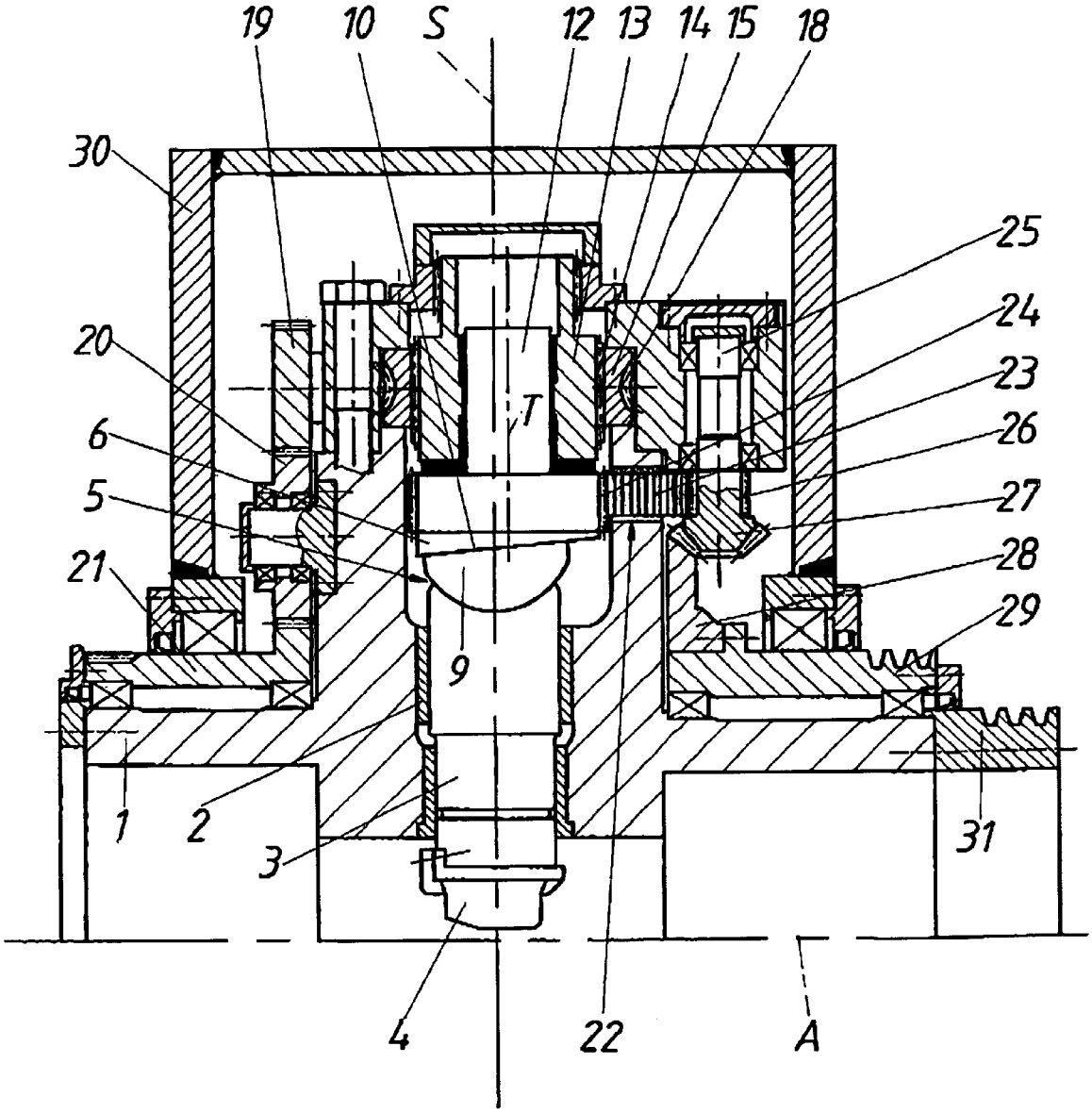
FIG. 3 shows another embodiment of an inventive forging machine in a sectional representation comparable to FIG. 2.

The embodiment illustrated in FIG. 3 shows a similar forging machine 1, where identical parts are also provided with identical reference numerals, with the exception that with this machine the forging box 3 is rotatably and drivably mounted in a machine frame 30 and can be rotated about the forging axis A via a drive indicated only with a drive gear 31, so that the forging machine can be used as swaging machine. Since the wobble plate drives 5 as well as the vertical position adjusting means together with their drives are arranged and supported on the machine box, the functions of lifting drives and vertical position adjusting means remain unchanged and can be used without any problem even while the forging box rotates at the same time.

What is claimed is:

1. A forging machine comprising (a) a forging box, (b) at least two forging punches guided in a longitudinal direction along a forging punch axis in the forging box and acting against each other, (c) a separate wobble-plate drive for displacing each one of the forging punches in the longitudinal direction, each wobble-plate drive comprising (1) a wobble plate rotatably drivable about a wobble axis, the wobble axis extending parallel to, but offset from, the forging punch axis, and the wobble plate being immovable along the wobble axis, and (2) a pressure plate engaging the wobble plate and supported on an end face of the forging punch, the pressure plate forming a ball-and-socket joint with the end face, and (d) pressure spring means biasing the forging punch in the longitudinal direction to press the pressure plate and the wobble plate into frictional engagement.

2. The forging machine of claim 1, wherein the wobble plate has a stub shaft, the stub shaft being rotatably, but axially immovably, mounted in a bearing sleeve, the bearing sleeve being axially adjustably mounted in the forging box.

3. The forging machine of claim 2, wherein the bearing sleeve has an external thread meshing with an adjusting nut, the adjusting nut being rotatably, but axially immovably, supported in the forging box, and further comprising a rotary drive connected to the adjusting nut.

4. The forging machine of claim 3, wherein the rotary drive comprises a drive gear and a central wheel mounted on the forging box, the drive gear meshing with the central wheel and the central wheel being rotatable about a forging axis extending perpendicularly to the longitudinal direction.

5. The forging machine of claim 1, further comprising a toothed-belt drive for rotatably driving the wobble plate, the wobble plate having a peripheral gear forming one of the gears of the toothed-belt drive.

6. The forging machine of claim 1, further comprising a common bevel gear transmission for rotatably driving all the wobble plates, the transmission including a large bevel gear mounted on the forging box for rotation about a forging axis extending perpendicularly to the longitudinal direction and a small bevel gear associated with each wobble plate and meshing with the large bevel gear.

7. The forging machine of claim 1, further comprising a machine frame, the forging box being mounted in the machine frame for rotation about a forging axis extending perpendicularly to the longitudinal direction.

* * * * *